United States Patent [19]

Thornburgh

[11] 4,153,025

[45] May 8, 1979

[54] FUEL TANK VAPOR FLOW CONTROL VALVE

[75] Inventor: William F. Thornburgh, Rochester, Mich.

[73] Assignee: General Motors Corporation, Detroit, Mich.

[21] Appl. No.: 856,654

[22] Filed: Dec. 2, 1977

[51] Int. Cl.[2] ..... F02M 59/00

[52] U.S. Cl. ..... 123/136

[58] Field of Search ..... 123/136

[56] References Cited

U.S. PATENT DOCUMENTS

| | | | |
|---|---|---|---|
| 3,769,952 | 11/1973 | Fiedler | 123/136 |
| 3,935,850 | 2/1976 | King | 123/136 |
| 4,044,743 | 8/1977 | Eaton | 123/136 |

*Primary Examiner*—Ronald B. Cox
*Attorney, Agent, or Firm*—Arthur N. Krein

[57] ABSTRACT

In an evaporative emission control system for a vehicle, the flow of fuel vapor from the fuel tank to the vapor storage canister in the system is controlled by a vapor flow control valve having a housing with a chamber therein in flow communication with the fuel tank to receive fuel vapor therefrom this chamber being connected to the vapor storage canister by a first vapor passage means and by a second vapor passage means, with flow from the chamber through the first vapor passage means being controlled by a diaphragm valve means that is normally biased closed by a spring, and which is responsive to either engine vacuum on one side thereof or to a predetermined fuel vapor pressure on its opposite side whereby to permit vapor flow and, the second vapor passage means including a sized bleed orifice passage used to control the rate of vapor flow to the storage canister via this second vapor passage means.

4 Claims, 2 Drawing Figures

FUEL TANK VAPOR FLOW CONTROL VALVE

This invention relates to an evaporative emission control system and, in particular, to such a system improved by the incorporation therein of a vapor flow control valve in accordance with the invention.

FIELD OF THE INVENTION

In recent years, many vehicles have been equipped with an evaporative emission control system of the type in which a vapor storage canister is used to receive and store fuel vapors emitted, in particular, from the fuel tank of the vehicle. During engine operation, the fuel vapor stored in the canister is purged therefrom, as usually controlled by a suitable purge control valve, into the engine induction system whereby such fuel vapors can be consumed by combustion within the engine.

In one form of such a system, the vapor storage canister is always in direct flow communication with the vapor outlet from the fuel tank and, it is apparent, that in such a system the canister, unless it is of very large capacity, can quickly be overloaded with fuel vapors. When this occurs, the result is a breakout of fuel vapors from the canister into the atmosphere. Because of this, in another form of such a system, vapor flow from the fuel tank to the vapor storage canister is controlled by a suitable flow control valve. In the prior art, such a flow control valve has normally been of a pressure or pressure-vacuum relief type, suitably positioned between the vapor outlet from the fuel tank and the vapor inlet into the vapor storage canister.

These latter described type evaporative emission control systems, having a vapor flow control valve incorporated therein to control vapor flow from a fuel tank to a vapor collector or storage canister, have been satisfactory when used on vehicles that are operated at low altitude. However, when such equipped vehicles are operated at low altitude, vapor breakout from the storage canister can and does occur. This is due to the fact that more vapor is released from the fuel at high altitude, especially if the fuel in the tank has a Reed Vapor Pressure (R.V.P.) value that is normal for fuel used at sea level. This excess fuel vapor flowing to the canister, when the vehicle engine is not in operation, can be more than that quantity which is capable of being absorbed, for example, by the charcoal in the canister, so that fuel vapor can then breakout, that is, it can flow out of the canister into the atmosphere.

This problem can obviously be solved by either increasing the overall size of the vapor storage canister or by placing several normal sized canisters in series or in parallel with each other but, both such solutions would result in an increased vehicle weight and in increased dimensions for the evaporative emission control system.

SUMMARY OF THE INVENTION

The present invention provides an improved evaporative emission control system for the internal combustion engine of a vehicle by providing an improved vapor flow control valve in the vent line between the fuel tank and the vapor storage canister in the system. The vapor flow control valve includes a housing providing a chamber therein to receive fuel vapor from the fuel tank, a first vapor passage means connected to the canister with flow from the chamber through this first vapor passage means controlled by a diaphragm valve member responsive to vapor pressure in the chamber acting on one side thereof or an engine manifold vacuum acting on the opposite side thereof to effect its unseating to permit flow through the first vapor passage means, and a second vapor passage means extending from the chamber and connected to the canister, the second vapor passage means including a sized bleed orifice passage for controlling the rate of flow of fuel vapor from the fuel tank to the canister.

It is therefore a primary object of this invention to provide an improved evaporative emission control system for a vehicle engine having a vapor flow control valve in the vent line between a fuel tank and a vapor storage canister that is operative to regulate the flow of fuel vapor from the fuel tank to the canister while controlling fuel tank pressure.

Another object of this invention is to improve a vehicle engine evaporative emission control system by the incorporation in the vent line between the fuel tank and a conventional sized vapor storage canister of a vapor flow control valve whereby vapor flow from the fuel tank to the vapor storage canister is regulated so as to prevent vapor breakout from the canister.

For a better understanding of the invention, as well as other objects and further features thereof, reference is had to the following description of the invention to be read in connection with the accompanying drawings.

FIG. 1 is a schematic view of an automotive evaporative emission control system having a preferred embodiment of a vapor flow control valve, in accordance with the invention, disposed in the fuel tank vent line, this valve being illustrated in enlarged sectional view; and, FIG. 2 is an enlarged sectional view of an alternate vapor flow control valve in accordance with the invention.

DESCRIPTION OF A PREFERRED EMBODIMENT

Figure 1:
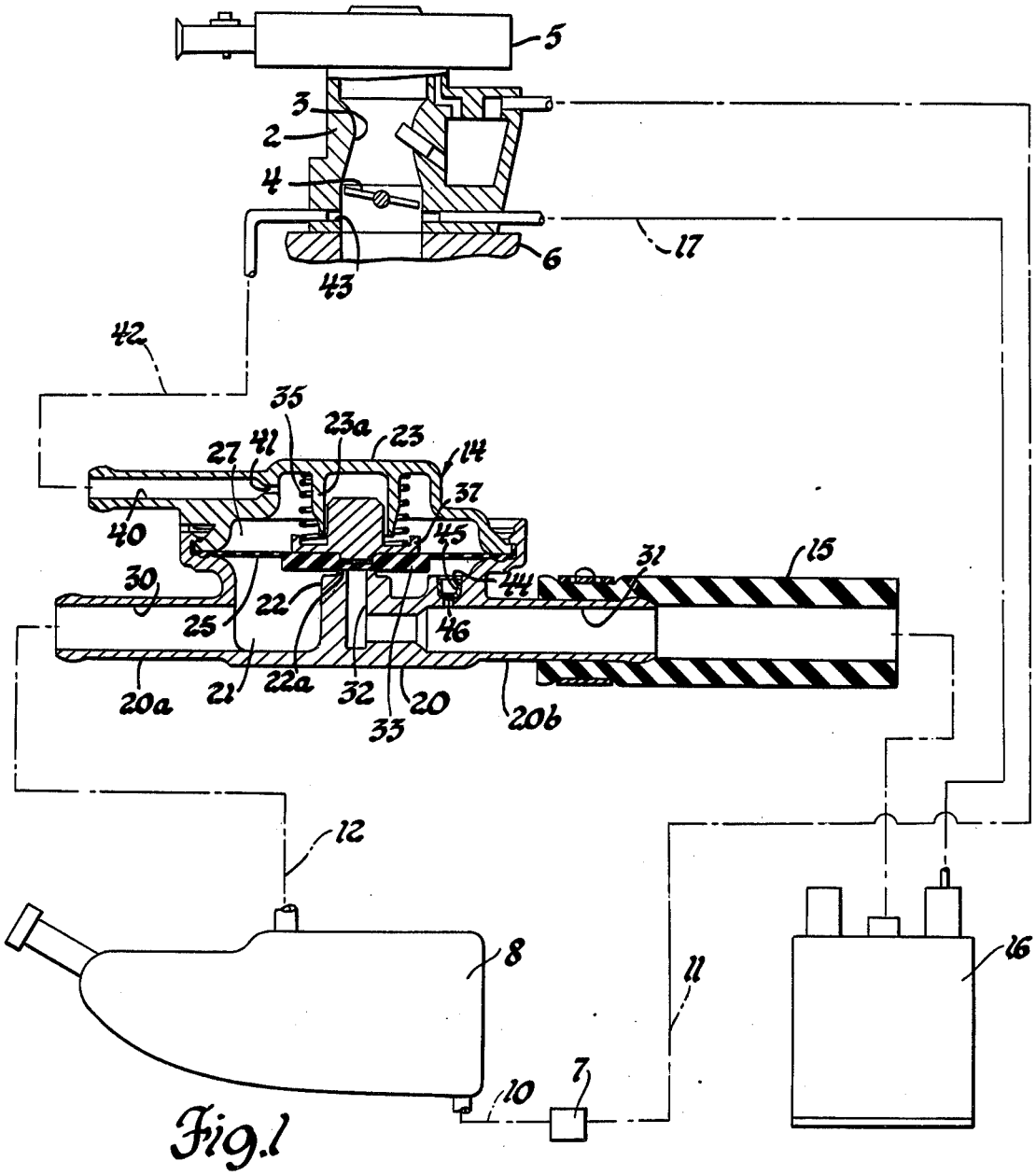

Referring first to FIG. 1, an internal combustion engine has an induction system, which in the construction illustrated, includes a carburetor 2 having an induction passage 3 therethrough with flow through the induction passage controlled by throttle valve 4, with an air cleaner 5 mounted on the carburetor. Induction fluid flowing though the induction passage 3 is delivered to an intake manifold 6 used to supply induction fluid to the combustion chambers, not shown, of the engine. The fuel bowl of carburetor 2 is supplied with fuel by a fuel pump 7 which draws liquid fuel from a fuel tank 8 through a fuel line 10 for delivery through a fuel line 11 suitably connected to the fuel bowl of the carburetor.

Fuel tank 8 has at least one vent line 12 extending from the upper portion of the tank to a vapor flow control valve, generally designated 14, constructed in accordance with the invention, and a vent line or conduit 15 extends from the control valve 14 to the fuel vapor inlet of a fuel vapor storage canister 16. Fuel vapor storage canister 16 can be of any suitable type, as for example, the type disclosed in U.S. Pat. No. 3,683,597 entitled "Evaporation Loss Control System" issued Aug. 15, 1972 to Thomas B. Beveridge and Ernest L. Ranft. Such a canister contains a quantity of fuel vapor absorbing carbon therein and has its bottom end or base open to the atmosphere. With this arrangement, during engine operation, air is drawn through the base of canister 16 and a purge line 17 into the induction passage 3. This air flow purges fuel vapor from the canister 16 and the fuel vapor and air mixture is delivered through the induction passage 3 to the engine.

The vapor flow control valve 14, in the construction illustrated in FIG. 1, includes a valve body or housing consisting of a base 20 providing a compartment or chamber for vapor therein, hereinafter referred to as chamber 21, with a central boss 22 therein and an upper inverted cup-shaped cover 23 suitably secured to the base 20. A flexible diaphragm 25, secured at its outer peripheral edge between the base 20 and cover 23, defines a vacuum chamber 27 with the cover 23 and separates this vacuum chamber 27 from chamber 21.

Base 20 is provided on one side with a tubular inlet fitting portion 20*a*, for connection to vent line 12, having an inlet passage 30 therethrough which opens into chamber 21 and base 20 on its other side is provided with a tubular outlet fitting portion 20*b*, for connection to vent line 15, having an outlet passage 31 therethrough and connecting at one end in communication with a first or primary vapor passage 32 which extends partly through boss 22 to open out through the upper valve seat 22*a* end of this boss, as seen in FIG. 1, for communication with chamber 21.

Flow of vapor from chamber 21 into primary vapor passage 32 is controlled by a valve member 33 supported by diaphragm 25 in position for movement between open and closed positions relative to valve seat 22*a* . Valve member 33 can be formed as a separate element suitably fixed to diaphragm 25 or, as shown, it can be formed integral with the diaphragm on one side thereof.

A coil spring 35, of predetermined value, loosely encircling a depending annular hollow boss 23*a* in cover 23, has one end thereof in abutment against an inner surface of cover 23 and its opposite end in abutment against diaphragm 25, with a spring retainer 37 sandwiched therebetween in the embodiment of FIG. 1, whereby to normally bias the valve member 33 to its closed position in seating engagement with valve seat 22*a*. The bias of spring 35 is preselected, taking into consideration the effective area on one side of diaphragm 25 that is exposed to the fuel vapors in chamber 21, so that when this vapor pressure rises to a predetermined level above atmospheric, 28 inches of water, for example, diaphragm 25, with the valve member 33, thereon, will be moved away from valve seat 22*a*, against the bias of spring 35, so that fuel vapors in chamber 21 can flow through primary vapor passage 32 and outlet passage 31 for continued flow to the canister 16.

For actuating the diaphragm 25 to effect opening movement of the valve member 33 against the biasing action of spring 35, as desired, the vacuum chamber 27 is supplied with induction manifold vacuum during operation via a port 40, having a flow control orifice 41 of predetermined size therein, that is provided in cover 23, this port 40 being connected as by a vacuum conduit 42 to a port 43 in the carburetor 2 that opens into the induction passage 3 downstream of the throttle valve 4.

Chamber 21 of the vapor flow control valve 14 is also adapted for controlled vapor flow communication with the canister 16 by a second or secondary vapor passage, which in the construction of the preferred embodiment illustrated in FIG. 1, is provided by a stepped bore passage 44 in base 20, that opens at one end into chamber 21 below the valve seat 22*a* and radially spaced outward therefrom, and at its other end into outlet passage 31, and by a thimble type orifice plug 45, with a predetermined sized bleed orifice passage 46 therethrough, that is press fitted, for example, into the enlarged bore portion of bore passage 44.

In operation, fuel vapors emitted from the fuel in fuel tank 8 will flow via vent line 12 and inlet passage 30 into the vapor chamber 21. Fuel vapors from chamber 21 can then flow at a rate, as controlled by the size of the bleed orifice passage 46, through the above-described secondary vapor passage and outlet passage 31, via vent line 15 to the canister 16 for storage therein when the engine is not in operation. Also when the engine is not in operation, the range of the fuel vapor pressure in chamber 21 and therefore in fuel tank 8 is controlled by movement of diaphragm 25 with the valve member 33 associated therewith, in an opening direction relative to valve seat 22*a* by the pressure of fuel vapor acting on the chamber 21 side of the diaphragm 25, as previously described.

Thus when the engine is not operating, only a limited amount of fuel vapor from fuel tank 8 will flow to the canister 16, unless of course, the vapor pressure in tank 8 reaches some relatively high predetermined value, at which time diaphragm 25 actuated valve member 33 will become unseated from valve seat 22*a*, to then permit fuel vapor to flow from tank 8 until the pressure of fuel vapor in tank 8 and chamber 21 is decreased sufficiently to again permit spring 35 to effect seating of valve mmember 33 against valve seat 22*a*.

Of course, during engine operation, the fuel vapor in canister 16 will be purged therefrom and delivered to the combustion cylinders of the engine for consumption therein in the usual manner, as previously described. In addition during engine operation, when the pressure differential across the diaphragm 25, due to the manifold signal in vacuum chamber 27 acting on one side of the diaphragm and vapor pressure in chamber 21 acting on the opposite side of the diaphragm, is sufficient to overcome the bias of spring 35, unseating of valve member 33 from valve seat 22*a* will occur, thereby permitting fuel vapor from fuel tank 8 to flow through the now unrestricted primary vapor passage of valve 14 to the canister 16 from where this fuel vapor will then be drawn into the engine for consumption therein. This latter described operating arrangement thus permits a normal flow of fuel vapor from the fuel tank through the flow control valve during engine operation so that substantially all fuel vapor is vented from the fuel tank 8 prior to termination of engine operation. Thus the fuel tank 8 is now conditioned so that it can then operate as a storage reservoir for fuel vapor up to some predetermined vapor pressure, as controlled by the subject control valve 14, in the manner previously described, when the engine is in operation.

Figure 2:
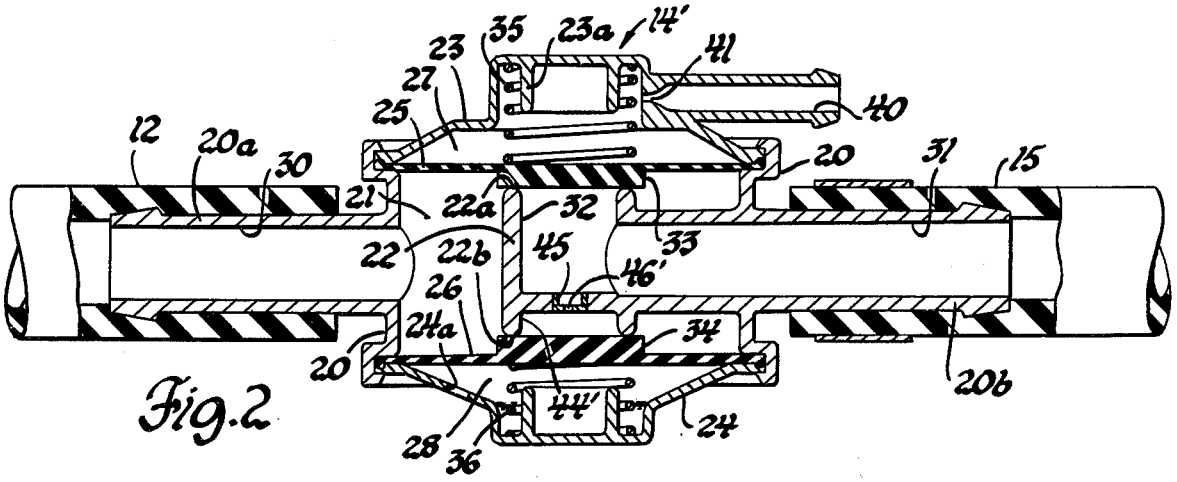

An alternate embodiment of a fuel vapor control valve, generally designated 14' in accordance with the invention is shown in FIG. 2, wherein similar parts are designated by similar numerals, but with the addition of a prime suffix after the reference numbers, where appropriate. In the alternate construction shown in this figure, the base 20 of the housing is closed by a lower cup-shaped cover 24 suitably secured to the lower end of the base and, a second flexible diaphragm 26 is secured between this cover 24 and the base 20 for defining an atmospheric chamber 28 with the cover 24, that is in communication with the atmosphere by at least one aperture 24*a* provided in the wall of cover 24, and for separating this atmospheric chamber 28 from the chamber 21 provided in base 20.

The secondary vapor passage in this alternate construction shown in FIG. 2 is provided by a bore passage 44' that extends from the lower or opposite end of the central boss 22 of base 20 from valve seat 22*a* and this bore passage opens at one end into the passage 32 and at its other end opens through a valve seat 22*b*, thus provided at this lower or opposite end of boss 22, so as to be in flow communication with chamber 21. To restrict flow through this secondary vapor passage, an orifice plug 45, with a bleed orifice passage 46' therethrough, is press fitted into a portion of the bore passage 44'. Flow of vapor from chamber 21 into this secondary vapor passage is controlled by a valve member 34 suitably supported by the diaphragm 26 for movement between an open position and a closed position relative to the valve seat 22*b*. A coil spring 36, of a predetermined value less than the value of the spring 35 acting against the diaphragm 25 in this structure, is positioned in the cover 24 to normally bias the diaphragm 26 and therefore the valve member 34 toward a closed position whereby to effect seating of the valve member 34 against the valve seat 22*b*.

As an example, the bias of the spring 36 can be selected so that when the fuel tank 8 vapor pressure flowing into the chamber 21 reaches a pressure, for example of between 20 to 25 inches of water, the diaphragm 26 will be flexed to effect movement of the valve member 34 away from the valve seat 22*b* to allow fuel tank vapors to flow through the secondary flow passage, as restricted by the size of the bleed orifice passage 46' therein, to the canister 16 while the value of the spring 35 could be selected so that when the fuel tank vapor pressure is, for example, above 28 to 35 inches of water, as predetermined, the diaphragm 25 will be moved to cause unseating of valve member 33 from the valve seat 22*a* whereby to permit unrestricted vapor flow throughout primary vapor passage 32 to the canister 16. This latter diaphragm 25, as in the embodiment of FIG. 1 previously described, will also be vacuum actuated during engine operation whereby to effect venting of the fuel tank 8 to the canister 16 through primary vapor passage 32 in the manner previously described.

This alternate embodiment fuel vapor flow control valve will operate in a manner similar to that of the embodiment of FIG. 1 as previously described except, that in this alternate embodiment fuel vapor will only flow through the secondary vapor passage when the vapor pressure in chamber 21 reaches some predetermined first pressure to overcome the bias of spring 36 whereby valve member 34 is unseated from valve seat 22*b* whereas, as previously described, in the valve embodiment of FIG. 1 the secondary vapor passage permits continuous flow communication between the fuel tank 8 and canister 16.

The embodiments of the invention in which an exclusive property or privilege is claimed are defined as follows:

1. In an evaporative emission control system for an internal combustion engine having a fuel tank for supplying fuel to the throttle valve controlled induction passage of the engine, a vapor storage canister used to store fuel vapor for delivery to the induction passage of the engine during engine operation, and a vent conduit means with a vapor flow control valve therein connecting a fuel vapor passage of the fuel tank to the inlet of the vapor storage canister, the improvement wherein said vapor flow control valve, for controlling flow of fuel vapor from the fuel tank to the vapor storage canister, includes a housing providing an internal cavity with an upstanding boss having a valve seat at one end and having a passage therein extending through said valve seat to be in communication with said cavity, valve means including a diaphragm positioned in said housing to divide said cavity into a vapor chamber on the one side thereof adjacent said valve seat and a vacuum chamber on the other side thereof, said housing having a vapor inlet to said vapor chamber connected to the fuel vapor passage of the fuel tank, an outlet connected at one end to said passage and its other end in communication with the inlet of the vapor storage canister, said valve means being movable in said housing relative to said valve seat between a first position blocking flow from said vapor chamber to said passage and a second position permitting vapor flow from said vapor chamber into said passage to said outlet, said valve means including spring means of a first predetermined force operatively positioned whereby said valve means is normally biased to said first position, a vacuum port in said housing opening at one end into said vacuum chamber and operatively connected at its other end to the induction passage downstream of the throttle valve whereby during engine operation manifold vacuum is applied to one side of said diaphragm to effect movement of said valve means to said second position when manifold vacuum is above a predetermined value, said valve means also being movable to said second position by fuel vapor pressure above a predetermined pressure acting on the side of the diaphragm exposed to the vapor chamber and, controlled flow passage means including a sized orifice passage in said housing providing a secondary vapor flow connection between said vapor chamber and said outlet.

2. In an evaporative emission control system according to claim 1 wherein said controlled flow passage means of said vapor flow control valve further includes a second valve seat at the opposite end of said boss with a flow passage means extending therethrough in communication with said sized orifice passage, a diaphragm valve means positioned in said housing to further divide said cavity into said vapor chamber on one side of said diaphragm valve means and an atmospheric pressure chamber on the opposite side of said diaphragm valve means, said housing having an aperture means therein to effect communication between said pressure chamber and the atmosphere, said diaphragm valve means being movable in said housing relative to said second valve seat between a first position blocking flow from said vapor chamber to said flow passage and a second position permitting flow from said vapor chamber to said flow passage and a second spring means, of a second predetermined force less than said predetermined force of said spring means, operatively positioned relative to said diaphragm valve means to normally bias said diaphragm valve means to said second position.

3. In an evaporative emission control system for an internal combustion engine having an induction system with flow therethrough controlled by a throttle valve and including a fuel tank for supplying fuel to the engine, a vapor storage canister to store fuel vapors for delivery to the engine, the fuel tank having a vapor passage connected by vent means including a vapor flow control valve to a vapor inlet of the vapor storage canister, the improvement wherein said vapor flow control valve includes a housing having a cavity therein with an inlet means thereto operatively connected to the vapor passage of the fuel tank and an outlet means therefrom operatively connected to the vapor inlet of the vapor storage canister, a diaphragm actuated valve means positioned in said housing to divide said cavity into a vacuum chamber on one side of said diaphragm actuated valve means and operative between a closed position and an open position to control vapor flow from said inlet to said outlet, spring means operatively positioned in said housing to normally bias said diaphragm actuated valve means to said closed position, a vacuum port in said housing opening at one end into said vacuum chamber and operatively connected at its other end to the induction system downstream of the throttle valve whereby during engine operation induction vacuum is applied to said one side of said diaphragm actuated valve means for moving said diaphragm actuated valve means to said open position during engine operation, said diaphragm actuated valve means also being movable to said open position when the fuel vapor pressure in said inlet means reaches some predetermined pressure to overcome the bias action of said spring means and, a controlled flow passage means including a sized orifice passage in said housing providing a secondary flow connection between said inlet means and said outlet means.

4. In an evaporative emission control system according to claim 3 wherein said controlled flow passage means of said vapor flow control valve further includes a pressure actuated valve means controlling flow through said controlled flow passage means upstream of said sized orifice passage in terms of the direction of flow from said inlet means to said outlet means, said pressure actuated valve means being operable to permit vapor flow through said controlled flow passage means when the fuel vapor pressure in said inlet means reaches some second predetermined pressure, said second predetermined pressure being less than said predetermined pressure required for actuating said diaphragm actuated valve to said open position.

* * * * *